US007358844B2

(12) United States Patent
Guenther et al.

(10) Patent No.: US 7,358,844 B2
(45) Date of Patent: Apr. 15, 2008

(54) CURRENT TRANSFORMER CORE AND METHOD FOR PRODUCING A CURRENT TRANSFORMER CORE

(75) Inventors: Wulf Guenther, Maintal (DE); Detlef Otte, Gruendau (DE); Joerg Petzold, Kahl (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 0 days.

(21) Appl. No.: 11/561,188

(22) Filed: Nov. 17, 2006

(65) Prior Publication Data

US 2007/0126546 A1 Jun. 7, 2007

Related U.S. Application Data

(63) Continuation of application No. PCT/EP2005/005353, filed on May 17, 2005.

(30) Foreign Application Priority Data

May 17, 2004 (DE) ..... 10 2004 024 337

(51) Int. Cl.
*H01F 27/28* (2006.01)

(52) U.S. Cl. ..... 336/233

(58) Field of Classification Search ..... 336/65, 336/83, 200, 233–234; 29/602.1; 148/108–121

See application file for complete search history.

(56) References Cited

U.S. PATENT DOCUMENTS

| | | | | |
|---|---|---|---|---|
| 4,881,989 | A | 11/1989 | Yoshizawa et al. | 148/302 |
| 5,160,379 | A | 11/1992 | Yoshizawa et al. | 148/108 |
| 5,252,148 | A * | 10/1993 | Shigeta et al. | 148/307 |
| 5,911,840 | A | 6/1999 | Coudechon et al. | 148/121 |
| 6,507,262 | B1 * | 1/2003 | Otte et al. | 336/213 |
| 2001/0001398 | A1 * | 5/2001 | Hasegawa et al. | 148/304 |
| 2004/0112468 | A1 | 6/2004 | Petzold et al. | 148/121 |
| 2006/0077030 | A1 * | 4/2006 | Herzer et al. | 336/223 |

FOREIGN PATENT DOCUMENTS

| | | |
|---|---|---|
| DE | 69711599 | 1/1996 |
| DE | 10045705 | 4/2002 |
| EP | 0271657 | 5/1939 |

(Continued)

OTHER PUBLICATIONS

Written Opinion for International Application No. PCT/EP2005/005353 (7 pages), May 17, 2005.

(Continued)

*Primary Examiner*—Tuyen T. Nguyen
(74) *Attorney, Agent, or Firm*—Baker Botts L.L.P.

(57) ABSTRACT

A current transformer core has a ratio of the core outside diameter $D_a$ to the core inside diameter $D_i$ of <1.5, a saturation magnetostriction $\lambda_s$ of =|4| ppm, a circular hysteresis loop with 0.50=Br/Bs=0.85 and an $H_{cmax}$=20 mA/cm. The current transformer core is made of a soft magnetic iron alloy in which at least 50% of the alloy structure is occupied by fine-crystalline particles with an average particle size of 100 nm or less, and the iron-based alloy comprises, in essence, one combination.

8 Claims, 10 Drawing Sheets

FOREIGN PATENT DOCUMENTS

| | | | |
|---|---|---|---|
| EP | 0299498 | A1 | 7/1988 |
| EP | 0299498 | B1 | 7/1988 |
| EP | 0504674 | A2 | 6/1992 |
| EP | 0504674 | B1 | 6/1995 |
| EP | 10134053 | | 1/2003 |
| JP | 03146615 | | 6/1991 |
| WO | 01/27946 | | 4/2001 |
| WO | 03/007316 | A1 | 1/2003 |
| WO | 03/007316 | A2 | 1/2003 |
| WO | 2005/114682 | | 12/2005 |

OTHER PUBLICATIONS

International Search Report for International Application No. PCT/EP2005/005353 (7 pages), Nov. 9, 2005.

International Preliminary Report on Patentability and Written Opinion for International Application No. PCT/EP2005/005353 (9 pages), Dec. 7, 2006.

G. Herzer, "Grain Structure and Magnetism of Nanacrystalline Ferromagnets", Reprinted from IEEE Transactions on Magnetics, vol. 25, No. 5, Sep. 1989, 4 pages.

* cited by examiner

CURRENT TRANSFORMER CORE AND METHOD FOR PRODUCING A CURRENT TRANSFORMER CORE

CROSS-REFERENCE TO RELATED APPLICATION

This application is a continuation of co-pending International Application No. PCT/EP2005/005353 filed May 17, 2005 which designates the United States, and claims priority to German application number DE 10 2004 024 337.9 filed May 17, 2004.

TECHNICAL FIELD

The invention relates to a current transformer core and a method for producing a current transformer core.

BACKGROUND

Power meters are used to determine the power consumption of electric devices and systems in the industry and in the home. Various principles are known, e.g., the principle of the electromechanical Ferraris meter based on measuring the rotation of a disk driven by current- and/or voltage-proportional fields.

Modern power meters operate fully electronically. In many cases the current is detected on the inductive principle, whereby output signals of inductive current and voltage transformers are processed digitally and may then be made available for determining consumption and then for remote readings.

Electronic power meters using inductive current transformers are increasingly being used in the home. The low cost of manufacturing such meters to some extent plays an even greater role than their technical superiority. This necessitates the development of especially economical manufacturing methods for such current transformers. The load currents to be measured are in the range between a few mA and 100 A or more; this requires an accurate and calibratable energy measurement with a corresponding low phase error and amplitude error of the measurement signal in comparison with the primary current to be measured. In addition to the required accuracy, the cost of materials for such current transformers and thus the cost of the transformer core material in particular are also important in large-scale manufacturing.

In general, the following equation holds for the phase error of a current transformer $$\tan\varphi \approx \frac{R_{Cu} + R_B}{\omega \cdot L} \cdot \cos\delta \tag{1}$$

$R_B$=resistance of the load;
$R_{Cu}$=resistance of the secondary winding
$\delta$=loss angle of the transformer material
L=inductance of the secondary side of the current transformer.

The amplitude error is given by the equation $$F(I) \approx -\frac{R_{Cu} + R_B}{\omega \cdot L} \cdot \sin\delta \tag{2}$$

The inductance L is defined as $$L = N_2^2 \cdot \mu \cdot \mu_0 \cdot \frac{A_{Fe}}{l_{Fe}} \tag{3}$$

$N_2$=secondary winding number
$\mu'$=permeability of the transformer material (real component)
$\mu_0$=general permeability constant
$A_{Fe}$=iron cross section of the core
$L_{Fe}$=average path length of the iron of the core.

There is therefore a demand for cores having the highest possible permeability for implementation of current transformers that have a smaller volume and are therefore less expensive but still have a high precision.

To detect high currents, the transformer core requires a large inside diameter, which leads to a small ratio of the core outside diameter $D_a$ to the core inside diameter $D_i$ of usually <1.5 or even <1.25 with a small iron cross section $A_{Fe}$. However, such small diameter ratios lead to a high mechanical instability of the core and make it sensitive to any type of mechanical manipulation.

For these reasons, highly permeable materials such as ferrites or Permalloy materials have been used in the past as materials for such current transformer cores. However, ferrites have the disadvantage that their permeability is comparatively low and depends relatively greatly on temperature. One property of Permalloy materials is that although a low-phase error is achieved, it varies greatly with the current to be measured and/or the control of the magnetic core. Equalization of this variation is possible by suitable electronic wiring of the transformer or digital reprocessing of the measured values, but this constitutes an additional cost-intensive expense. Because of the fracture sensitivity of ferrites and the high magnetostriction and low saturation induction of both classes of materials, transformer cores having a small iron cross section that saves on material, i.e., a low $D_a/D_i$ diameter ratio cannot be implemented.

Use of highly permeable magnetic cores made of nanocrystalline materials having a high saturation induction is also known from the state of the art, e.g., EP 05 04674 B1. However, these materials have a flat hysteresis loop in contrast with the present invention. Therefore, there is a demand for dimensioning current transformer cores having a large $A_{Fe}$ with the permeability values that can be achieved in this way ($\mu$ approx. 60,000 to 120,000). Despite the good properties, especially with regard to the phase trend, economical use in mass production is therefore impossible.

SUMMARY

The exists a need for an inexpensive current transformer core that is highly permeable over a wide induction range as well as a method for manufacturing such a highly permeable current transformer core.

A current transformer core may comprise a ratio of the core outside diameter $D_a$ to the core inside diameter $D_i$ of <1.5, a saturation magnetostriction $\lambda_s \leqq |4|$ ppm, a round hysteresis loop with $0.50 \leqq Br/Bs \leqq 0.85$ and an $H_{cmax} \leqq 20$ mA/cm, whereby the current transformer cores consist of a soft magnetic iron-based alloy in which at least 50% of the alloy structure consists of fine crystalline particles with an average particle size of 100 nm or less and the iron-based alloy has essentially the composition:

$$(Fe_{x-a}Co_aNi_b)_xCu_yM_zSi_vB_w$$

where M denotes an element from the group V, Nb, W, Ta, Zr, Hf, Ti, Mo or a combination thereof and in addition:

x+y+z+v+w=100%, where

Fe+Co+Ni=x=100%−y−z−v−w

Co a≦1.5 at %

Ni b≦1.5 at %

Cu 0.5≦y≦2 at %

M z≦5 at %

Si 6.5≦v≦18 at %

B 5≦w≦14 at % wherein v+w>18 at %.

According to an embodiment, a current transformer core may further comprise a saturation magnetostriction $\lambda_s \leqq |2|$ ppm, a round hysteresis loop with 0.50≦Br/Bs≦0.70 and an $H_{cmax} \leqq 10$ mA/cm, whereby the current transformer core is made of a soft magnetic iron-based alloy in which at least 50% of the alloy structure consists of fine crystalline particles with an average particle size of 100 nm or less and the iron-based alloy has essentially the composition:

$$(Fe_{x-a}Co_aNi_b)_xCu_yM_zSi_vB_w$$

where M denotes an element from the group V, Nb, W, Ta, Zr, Hf, Ti, Mo or a combination thereof and in addition:

x+y+z+v+w=100%, where

Fe+Co+Ni=x=100%−y−z−v−w

Co a≦0.5 at %

Ni b≦0.5 at %

Cu 0.75≦y≦1.25 at %

M 2.0≦z≦3.5 at %

Si 13≦v≦16.5 at %

B 5≦w≦9 at % whereby 20≦v+w≦25 at %. According to an embodiment, a current transformer core may further comprise a saturation magnetostriction $\lambda_s \leqq |0.8|$ ppm, a round hysteresis loop with 0.65≦Br/Bs≦0.50 and an $H_{cmax} \leqq 10$ mA/cm, whereby the current transformer core is made of a soft magnetic iron-based alloy in which at least 50% of the alloy structure consists of fine crystalline particles with an average particle size of 100 nm or less and the iron-based alloy has the following stoichiometric ratio:

$$(Fe_{x-a}Co_aNi_b)_xCu_yM_zSi_vB_w$$

where M denotes an element from the group V, Nb, W, Ta, Zr, Hf, Ti, Mo or a combination thereof and in addition:

x+y+z+v+w=100%, where

Fe+Co+Ni=x=100%−y−z−v−w

Co a≦0.5 at %

Ni b≦0.5 at %

Cu 0.75≦y≦1.25 at %

M 2.0≦z≦3.5 at %

Si 13≦v≦16.5 at %

B 5≦w≦9 at % whereby 20≦v+w≦25 at %. According to an embodiment, the current transformer core may comprise a $\mu_4$>90,000. According to an embodiment, the current transformer core may comprise a $\mu_{max}$>350,000. According to an embodiment, the current transformer core may comprise a saturation induction $B_s \leqq 1.4$ Tesla. According to an embodiment, the current transformer core may comprise a current transformer having a phase error <1°. According to an embodiment, the current transformer core may be designed as a ring strip-wound core having at least one primary winding and at least one secondary winding.

A method for manufacturing ring-shaped current transformer cores having a ratio of the core outside diameter $D_a$ to the core inside diameter $D_i$<1.5 consisting of a soft magnetic iron-based alloy, whereby at least 50% of the volume of the alloy structure consists of fine crystalline particles having an average particle size of 100 nm or less, may comprise the following steps: a) Preparing an alloy melt; b) Manufacturing an amorphous alloy strip from the alloy melt by rapid solidification technology; c) Stress-free winding of the amorphous strip to form amorphous current transformer cores; d) Heat treatment of the unstacked amorphous current transformer cores in one pass to form nanocrystalline current transformer cores while extensively excluding the influence of magnetic fields.

According to an embodiment, the heat treatment may be performed in an inert gas atmosphere 20. According to an embodiment, the heat treatment may be performed in a reducing gas atmosphere. According to an embodiment, the amorphous strip may be coated with electric insulation before winding. According to an embodiment, the current transformer core may be immersed in an insulation medium after winding. According to an embodiment, the heat treatment of the unstacked amorphous current transformer cores may be performed on heat sinks having a high thermal capacity and a high thermal conductivity. According to an embodiment, a metal or a metallic alloy, a metal powder or a ceramic may be provided as the material for the heat sinks. According to an embodiment, the metal or metal powder may be copper, silver or a thermally conductive steel. According to an embodiment, a ceramic powder may be provided as the material for the heat sinks. According to an embodiment, the ceramic or ceramic powder may be magnesium oxide, aluminum oxide or aluminum nitride. According to an embodiment, the heat treatment may be performed in a temperature interval from approx. 440° C. to approx. 620° C. According to an embodiment, a constant temperature may be maintained for a period of up to 150 minutes in the heat treatment between 500° C. and 600° C. According to an embodiment, the constant temperature may be achieved at a heating rate of 0.1 K/min up to 100 K/min. According to an embodiment, heating phases in which the heating rate is lower than that of the first heating phase and the second heating phase may exist in the heat treatment in the range of 440° C. and 620° C. According to an embodiment, the dwell time in the totality of the annealing zones may be between 5 and 180 minutes. According to an embodiment, the current transformer may have a phase error <1°. According to an embodiment, $\mu_4$>90,000. According to an embodiment, $\mu_{max}$>350,000. According to an embodiment, the method may comprise a saturation induction Bs of 1.1 to 1.4 Tesla. According to an embodiment, the method may comprise a magnetic total isotropy according to $K_{tot}$<2 J/m$^3$.

BRIEF DESCRIPTION OF THE DRAWINGS

The invention is illustrated below as an example on the basis of the drawing, in which.

DETAILED DESCRIPTION

Figure 1:
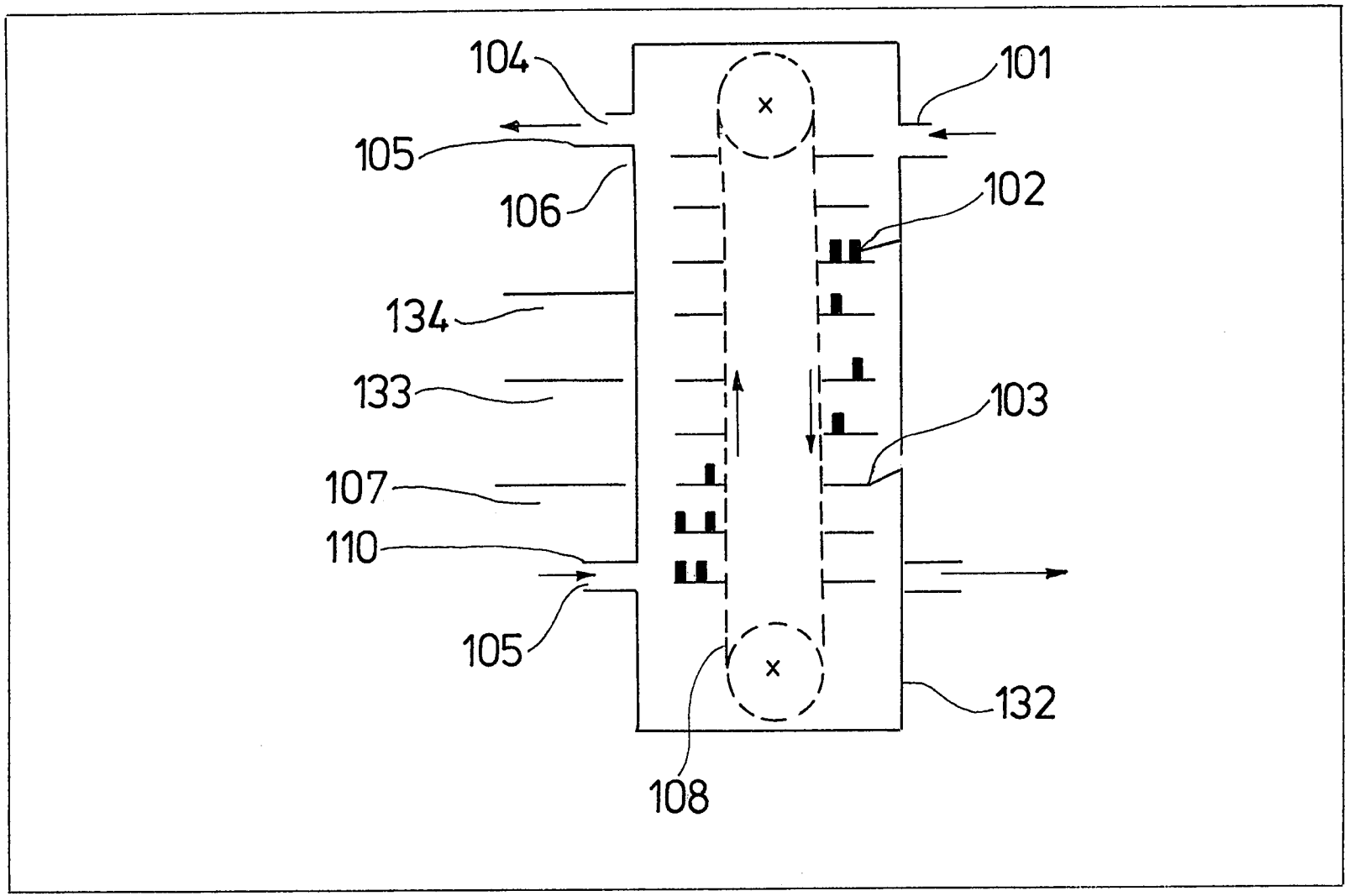
FIG. 1 shows schematically in cross section a tower furnace having a conveyor belt running vertically.

A current transformer cores may have a ratio of the core outside diameter $D_a$ to the core inside diameter $D_i$<1.5, having a saturation magnetostriction $\mu_s \leqq |6|$ ppm, a round hysteresis loop with $0.50 \leqq Br/Bs \leqq 0.85$ and an $H_{cmax} \leqq 20$ mA/cm, whereby the current transformer cores consist of a soft magnetic iron-based alloy in which at least 50% of the alloy structure is formed by fine crystalline particles having an average particle size of 100 nm or less and the iron-based alloy has essentially the following composition:

$$(Fe_{x-a}Co_aNi_b)_xCu_yM_zSi_vB_w$$

where M is an element from the group V, Nb, W, Ta, Zr, Hf, Ti, Mo or a combination thereof and it additionally holds that:

x+y+z+v+w=100%, where
Fe+Co+Ni=x=100%−y−z−v−w
Co $a \leqq 1.5$ at %
Ni $b \leqq 1.5$ at %
Cu $0.5 \leqq y \leqq 2$ at %
M $1 \leqq z \leqq 5$ at %
Si $6.5 \leqq v \leqq 18$ at %
B $5 \leqq w \leqq 14$ at % whereby v+w>18 at %. The Br/Bs ratio is understood here to refer to the ratio of the remanence Br to the saturation induction Bs.

Current transformer cores having a saturation magnetostriction $\mu_s \leqq |2|$ ppm, a round hysteresis loop with $0.50 \leqq Br/Bs \leqq 0.85$ and $H_{cmax} \leqq 12$ mA/cm are preferred, whereby the current transformer cores are made of a soft magnetic iron-based alloy in which at least 50% of the alloy structure consists of fine crystalline particles having an average particle size of 100 nm or less and the iron-based alloy has essentially the following composition:

$$(Fe_{x-a}Co_aNi_b)xCuyMzSivBw$$

where M is an element from the group V, Nb, W, Ta, Zr, Hf, Ti, Mo or a combination thereof and it additionally holds that:

x+y+z+v+w=100%, where
Fe+Co+Ni=x=100%−y−z−v−w
Co $a \leqq 0.5$ at %
Ni $b \leqq 0.5$ at %
Cu $0.75 \leqq y \leqq 1.25$ at %
M $2 \leqq z \leqq 3.5$ at %
Si $13 \leqq v \leqq 16.5$ at %
B $5 \leqq w \leqq 9$ at % whereby $20 \leqq v+w \leqq 25$ at %.

Current transformer cores having a saturation magnetostriction $\lambda_s \leqq |0.8|$ ppm, a round hysteresis loop with $0.65 \leqq Br/Bs \leqq 0.80$ and $H_{cmax} \leqq 10$ mA/cm are especially preferred, whereby the current transformer cores are made of a soft magnetic iron-based alloy in which at least 50% of the alloy structure consists of fine crystalline particles having an average particle size of 100 nm or less and the iron-based alloy has essentially the following composition:

$$(Fe_{x-a}Co_aNi_b)xCuyMzSivBw$$

where M is an element from the group V, Nb, W, Ta, Zr, Hf, Ti, Mo or a combination thereof and it additionally holds that:

x+y+z+v+w=100%, where
Fe+Co+Ni=x=100%−y−z−v−w
Co $a \leqq 0.5$ at %
Ni $b \leqq 0.5$ at %
Cu $0.75 \leqq y \leqq 1.25$ at %
M $2 \leqq z \leqq 3.5$ at %
Si $13 \leqq v \leqq 16.5$ at %
B $5 \leqq w \leqq 9$ at % whereby $20 \leqq v+w \leqq 25$ at %.

The current transformer cores typically have a permeability of $\mu_4$>90,000 at H=4 mA/cm and a frequency of 50 Hz or 60 Hz and have a maximum permeability $\mu_{max}$>350,000 at a frequency of 50 Hz or 60 Hz. Furthermore, the current transformer core has a saturation inductance $B_s \leqq 1.4$ Tesla. In preferred embodiments, the current transformer core has a permeability of $\mu_1$>90,000 at 1 mA/cm, more preferably $\mu_1$>140,000 and optimally $\mu_1$>180,000.

Such current transformer cores are excellently suited for use in a current transformer having a phase error of <1°. These current transformer cores are typically designed as ring strip-wound cores having at least one primary winding and at least one secondary winding.

The invention also provides a method for manufacturing ring-shaped current transformer cores made of nanocrystalline material having a round hysteresis loop. Such cores having a mechanical sensitivity cannot currently be produced in a technically and economically satisfactory manner with the methods known so far, especially heat treatment in the stack in a retort furnace. This object is achieved according to the present invention by a method for manufacturing ring-shaped current transformer cores having a ratio of the core outside diameter $D_a$ to the core inside diameter $D_i$<1.5 consisting of a soft magnetic iron-based alloy, whereby at least 50% of the alloy structure consists of fine crystalline particles having an average particle size of 100 nm or less, with the following steps:

a) Providing an alloy melt;
b) Producing an amorphous alloy strip from the alloy melt by means of a rapid solidification technology;
c) Stress-free winding of the amorphous strip to form amorphous current transformer cores;
d) Heat treatment of the unstacked amorphous current transformer cores, e.g., in run-through to form nanocrystalline current transformer cores while largely excluding the influence of magnetic field. This is typically followed by the step:
e) solidification of the core, e.g., by impregnation, coating, sheathing with a suitable plastic material and/or encapsulation.

It is thus possible to manufacture current transformer cores having round and extremely highly permeable hysteresis loops with an induction range that can be used over a wide area due to the high saturation induction of Bs=1.1 to 1.4 T and a good frequency response with respect to the permeability and comparatively low remagnetization losses.

With current transformers, especially good properties are achieved with the alloy compositions that are emphasized as being "preferred" because it is known that a zero passage of the saturation magnetostriction can be achieved with an adjusted heat treatment.

Using such a magnetic material, nanocrystalline cores having a round hysteresis loop in which the Br/Bs ratio, i.e., the remanence flux density divided by the saturation flux density, is greater than 0.5 and up to 0.85 can be produced to advantage. Furthermore, the permeability μi may be >100,000, μmax>350,000 and a saturation induction that may be between 1.1 T and 1.4 T is achieved. Due to the high initial and maximum permeability and the high saturation induction, the iron cross section and thus the weight and price of the transformer core can be reduced significantly for mass production.

Nanocrystalline soft magnetic iron-based alloys have long been known and have been described, for example, in EP 0 271 657 B1 and in WO 03/007316 A2, for example.

In the two alloy systems described in WO 03/007316 A2, at least 50% of the alloy structure consists of fine crystalline particles having an average particle size of 100 nm or less. These soft magnetic nanocrystalline alloys are being used to an increasing extent as magnetic cores in inductors for a wide variety of electrotechnical applications. This is described, for example, in EP 0 299 498 B1.

The nanocrystalline alloys in question here can be produced by the so-called rapid solidification technology (e.g., by means of melt spinning or planar flow casting). In this process, first an alloy melt is prepared in which an initially amorphous alloy strip is manufactured subsequently by rapid quenching from the melt state. The cooling rates required for the alloy systems in question above amount to approximately $10^6$ K/sec. This is achieved with the help of the melt spin method in which the melt is sprayed through a narrow nozzle onto a rapidly rotating cooling roller and solidifies to a thin strip in the process. This method allows continuous production of the thin strips and films in a single operation directly from the melt at a rate of 10 to 50 m/sec, with a possible strip thickness of 14 to 50 μm and a strip width of up to a few cm being possible.

The initially amorphous strip produced by this rapid solidification technology is then rolled to form geometrically vastly variable magnetic cores which may be oval, rectangular or round.

The central step toward achieving good soft magnetic properties is "nanocrystallization" of the alloy strips which are still amorphous up to this point. These alloy strips still have poor properties from a soft magnetic standpoint because they have a relatively high magnetostriction $|\lambda_s|$– of approx. $25\times10^{-6}$. When performing a crystallization heat treatment tailored to the alloy, an ultrafine structure is obtained, i.e., an alloy structure in which at least 50% of the volume consists of cubic space-centered FeSi crystallites. These crystallites are embedded in a residual amorphous phase consisting of metals and metalloids. The background for the development of the fine crystalline structure from the standpoint of solid state physics and the resulting drastic comprehensive improvement in soft magnetic properties is described, for example, by G. Herzer, *IEEE Transactions on Magnetics,* 25 (1989), pp. 3327 ff. According to this, good soft magnetic properties such as a high permeability or low hysteresis losses are obtained by averaging out the crystal anisotropy $K_1$ of the randomly oriented nanocrystalline "structure."

According to the conventional art as disclosed in EP 0 271 657 B1 and/or EP 0 299 498 B1, the amorphous bands are initially rolled onto ring strip-wound cores on special winding machines with the lowest possible stress. To do so, the amorphous strip is first wound to form a round ring strip-wound core and brought to a shape that differs from the round shape by means of suitable shaping tools, if necessary. Due to the use of suitable coil bodies, however, shapes that differ from the round shape can also be produced directly in winding the amorphous strips to form ring strip-wound cores.

Then according to the conventional art, the ring strip-wound cores that are rolled up in a stress free manner are subjected to a crystallization heat treatment in so-called retort furnaces to achieve the nanocrystalline structure. In doing so, the ring strip-wound cores are stacked one above the other and then run into such a furnace. It has been found that one important disadvantage of this method is that the magnetic values in the magnetic core stack have a dependence on position due to weak magnetic scattering fields such as the earth's magnetic field. Whereas high permeability values with an intrinsically high remanence ratio of more than 60% occur at the edges of the stack, for example, the magnetic values in the area of the center of the stack are characterized by more or less pronounced flat hysteresis loops with low values with regard to permeability and remanence. In addition, annealing of the stack performed on current transformer-specific cores in particular those having a low $D_a/D_i$ ratio, may lead to substantial mechanical deformation, resulting in an exacerbation of the magnetic properties.

With the nanocrystalline alloy systems in question, the nanocrystalline structure is typically achieved at temperatures of $T_a$=440° C. to 620° C., whereby the required holding times may be between a few minutes and approximately 12 hours. In particular, U.S. Pat. No. 5,911,840 discloses that in the case of nanocrystalline magnetic cores having a round B-H loop, a maximum permeability of $\mu_{max}$=760,000 can be achieved if a steady-state temperature plateau is used for a period of 0.1 to 10 hours below the temperature of 250° C. to 480° C. required for crystallization in order to relax the magnetic core. However, this increases the length of the heat treatment and thus makes the process less economical.

Due to the inventive separation of the current transformer cores during the heat treatment, an identical magnetostatic condition for each individual ring strip-wound core is achieved. The great demagnetization factor of the individual core in contrast with the core stack prevents magnetization in the axial direction. The result of this identical magnetostatic crystallization condition for each individual transformer core is that the magnetic value scattering is restricted to alloy-specific, geometric and/or thermal causes. This makes it possible to rule out stack-induced field bundling.

To minimize magnetoelastic anisotropies that would result in a decline in permeability, the heat treatment is coordinated with the alloy compositions so that the magnetostriction contributions of fine crystalline grain and amorphous residual phase compensate one another, thus yielding a minimized magnetostriction of $\lambda_s$<2 ppm, preferably even <0.8 ppm. On the other hand, the continuous method described here in contrast with stack annealing in a retort furnace allows stress-free annealing of the cores. The latter is a great advantage especially with the current transformer cores which have a small diameter ratio $D_a/D_i$ in question here and which are usually mechanically unstable. First, this reduces the magnetomechanical anisotropies further; second, the cores retain their original shape, usually round, despite the low mechanical stability. Furthermore, it is important that in the continuous run-through process which the individual current transformer cores run through there is no contact among the cores or with other parts that could result in deformation or stresses, and that, moreover, a protective gas atmosphere is maintained, resulting in surface oxidation or crystallization being prevented. To this end, a reducing gas atmosphere, in particular with a dry gas, may be provided.

To fulfill the application-related requirements of a small imaginary part of the complex permeability, which is necessary in conjunction with reducing remagnetization losses, it is proven advantageous for the amorphous strip to be coated with electric insulation before winding. This results in a low loss angle δ and thus to minimization of the amplitude error in equation (2).

Depending on the requirement, the coating may be applied optionally by an immersion method, a continuous flow-through method, a spray method or an electrolysis method. It is also possible for the current transformer core to be immersed in an insulation medium after winding.

The insulating medium is to be selected so that it adheres well to the surface of the strip but does not cause any surface reactions that could damage the magnetic properties. In conjunction with the present alloy system, oxides, acrylates, phosphates, silicates and chromates of the elements Ca, Mg, Al, Ti, Zr, Hf and Si have proven successful.

It has been found to be especially advantageous to apply a liquid preproduct containing magnesium to the surface of the strip, which is then converted into a dense layer of magnesium oxide during a special heat treatment which does not affect the alloy; the thickness of this layer may be between approx. 30 nm and 1 mm and adheres securely to the surface of the strip.

After the heat treatment, the magnetic core is finally solidified, e.g., by impregnation, coating, sheeting with suitable plastic materials and/or encapsulation. In encapsulation, e.g., by gluing in protective troughs, care must be taken [to prevent] stress-induced variation in the amplitude and phase errors with temperature. When using a soft elastic adhesive, it has been found that a change in temperature toward high temperatures in comparison with room temperature as well as low temperatures leads to additional linearity deviations in the transformer errors. Tensile stresses and compressive stresses occur in the core here, transmitted from the trough material because of the elastic behavior of the hardened adhesive. A definite reduction in this effect has been achieved by using a soft plastic nonreactive paste as the filling compound instead of a soft elastic reactive adhesive. In this way, the linearity values have been kept almost constant within a temperature range of −40° C. to +85° C.

The invention also relates to the method for manufacturing current transformer cores according to patent Claim 1 as well as the current transformer cores manufactured by this method for current transformers having a phase error <1°.

It has been found that small-phase errors can be implemented with current transformers having current transformer cores manufactured in this way due to the temperature treatment described here with the ambient conditions also described here and using the stated alloy system.

In manufacturing a current transformer, a primary winding and a secondary winding must each be provided.

In summary, to achieve a round hysteresis loop with a high initial permeability and maximum permeability and/or a low coercitive field ($H_c$<15 mA/cm), the following conditions are important and/or advantageous, in particular to create no anisotropies with anisotropy energies $K_{tot}$>2 J/m$^3$ after the heat treatment:

I. External magnetic fields must be prevented during the heat treatment, even those arising due to flux bundling of the earth's magnetic field;

II. Preventing stresses within the strip material, e.g., due to surface oxidation or crystallization;

III. Preventing stresses during the heat treatment inside the core or from the outside onto the core due to stress-free winding, stacking for annealing and equalization of the magnetostriction in the heat treatment method;

IV. Preventing stresses in solidification;

V. Preventing stresses in use of the current transformer cores, i.e., in winding and in installation in current transformers.

Through the inventive method, it is possible to manufacture transformer cores having a greater mechanical instability with a ratio of core outside diameter to core inside diameter of <1.5, especially even <1.25. Such transformer cores cannot be manufactured by traditional methods, especially if they are stacked during the heat treatment because they are easily damaged in manipulation or transport into the furnace or they build up internal stresses.

In crystallization process, i.e., during the heat treatment described here, it is necessary to recall that this is an exothermic reaction and that the heat of crystallization releases must be removed from the core. The heat treatment of the unstacked amorphous ring strip-wound cores is preferably performed on heat sinks having a high thermal capacity and a high thermal conductivity. The principle of the heat sink is already known from JP 03 146 615 A2. However, heat sinks are used there only for steady-state annealing. A metal or a metallic alloy may be used as the material for the heat sinks there. The metals copper, silver and thermally conductive steel have proven to be especially suitable.

However, it is also possible to perform the heat treatment on a heat sink made of ceramic. In addition, an embodiment of the present invention in which the amorphous ring strip-wound core is treated with heat are embedded in a molding bed of ceramic powder or metal powder, preferably copper powder, is also conceivable.

Magnesium oxide, aluminum oxide and aluminum nitride have proven especially suitable ceramic materials, as well as for a solid ceramic plate or for a ceramic powder bed.

The heat treatment for crystallization is performed in a temperature interval from approx. 450° C. to approx. 620° C. The sequence is normally subdivided into various temperature phases for inducing the crystallization process and for ripening of the structure, i.e., for compensation of magnetostriction.

The inventive heat treatment is preferably performed using a furnace, whereby the furnace has a furnace housing, the at least one annealing zone and a heat source, means for charging the annealing zone with unstacked amorphous magnetic cores, means for conveying the unstacked amorphous magnetic cores through the annealing zone and means for removing the unstacked heat-treated nanocrystalline magnetic cores from the annealing zone.

The annealing zone of such a furnace preferably receives a protective gas.

In a first embodiment of the present invention, the furnace housing is in the form of a tower furnace in which the annealing zone runs vertically. The means for conveying the unstacked amorphous magnetic cores through the vertically running annealing zone preferably consist of a conveyor belt running vertically.

The conveyor belt running vertically has supports of a material having a high thermal capacity perpendicular to the conveyor belt surface, i.e., made of either the metals described above or the ceramics described above which have a high thermal capacity and a high thermal conductivity. The ring strip-wound cores rest on the supports.

The annealing zone running vertically is preferably subdivided into multiple separate heating zones equipped with separate heating regulating units.

In an alternative embodiment of the inventive furnace, it is in the form of a tower furnace in which the annealing zone runs horizontally. The annealing zone running horizontally is in turn subdivided into multiple separate heating zones which are equipped with separate heating regulating units. Then at least one but preferably several supporting plates rotating about the axis of tower furnace in the form of a carousel are provided as the means for conveying the unstacked amorphous ring strip-wound cores through the annealing zone running horizontally.

The support plates on which the transformer cores sit in turn are made entirely or partially of a material having a high thermal capacity and a high thermal conductivity. In particular plates made of the metals mentioned above such as copper, silver or heat-conducting steel or ceramics may be used here.

In a third alternative embodiment of the furnace, it has a furnace housing having the shape of a horizontal continuous furnace in which the annealing zone also runs horizontally. This embodiment is especially preferred because such a furnace is relatively simple to manufacture.

A conveyor belt is provided as the means for conveying the unstacked amorphous transformer cores through the annealing zone running horizontally, whereby the conveyor belt is preferably in turn provided with supports which are made of a material having a high thermal capacity and a high thermal conductivity with the ring strip-wound cores sitting thereon. The metallic and/or ceramic materials discussed above may again be used here.

Here again, the horizontally running annealing zone is typically subdivided into several separate heating zones, each equipped with separate heating regulating units.

For producing so-called hysteresis loops, annealing methods that allow the development and maturation of an ultrafine nanocrystalline structure under the most thermally accurate conditions possible in the absence of field are needed. As mentioned above, annealing in the state of the art is normally performed in so-called retort furnaces into which the transformer cores are introduced, stacked one above the other.

The decisive disadvantage of this method is that due to weak stray fields such as the earth's magnetic field or similar stray fields, a positioned dependence of the magnetic characteristic values in the magnetic core stack is induced due to field deflection effects and bundling effects.

In addition to the magnetostatic effects, the stack annealing in retort furnaces has the additional disadvantage that with increasing weight of the magnetic core, the exothermic heat of the crystallization process can be emitted to the environment only incompletely. The result is overheating of the stacked magnetic core, which may lead to lower permeabilities and high coercitive field strengths. To avoid these problems, it is necessary to perform the heating very slowly in the range of onset of crystallization, i.e., above approximately 450° C., but that is not economical. Typical heating rates there would be 0.1 to 0.2 K/min, which means that it may take up to seven hours to pass through the range up to 490° C.

The only economically feasible large-scale industrial alternative to stack annealing in a retort furnace is annealing of individual separate transformer cores in one pass. Identical magnetostatic and thermal conditions for each individual transformer core are created by the separation of the transformer cores in the continuous method.

The rapid heating rate typical of continuous annealing can be lead to an exothermic release of heat even when the magnetic cores are separated, which in turn causes progressive damage to the magnetic properties that increases with the weight of the core. This effect could be counteracted by slower heating.

However, since delayed heating would result in an uneconomical increase in the length of the continuous zone, this problem can be solved by introducing heat-absorbing substrates (heat sinks) made of metals having a high thermal conductivity or by using metallic or ceramic powder beds. Copper plates have proven especially suitable because they have a high specific thermal capacity and a very good thermal conductivity. Therefore, the exothermic heat of crystallization can be withdrawn from the ends of the magnetic cores. In addition, such heat sinks reduce the actual heating rate of the cores, so the isothermic excess temperature can be further limited.

Figure 7:
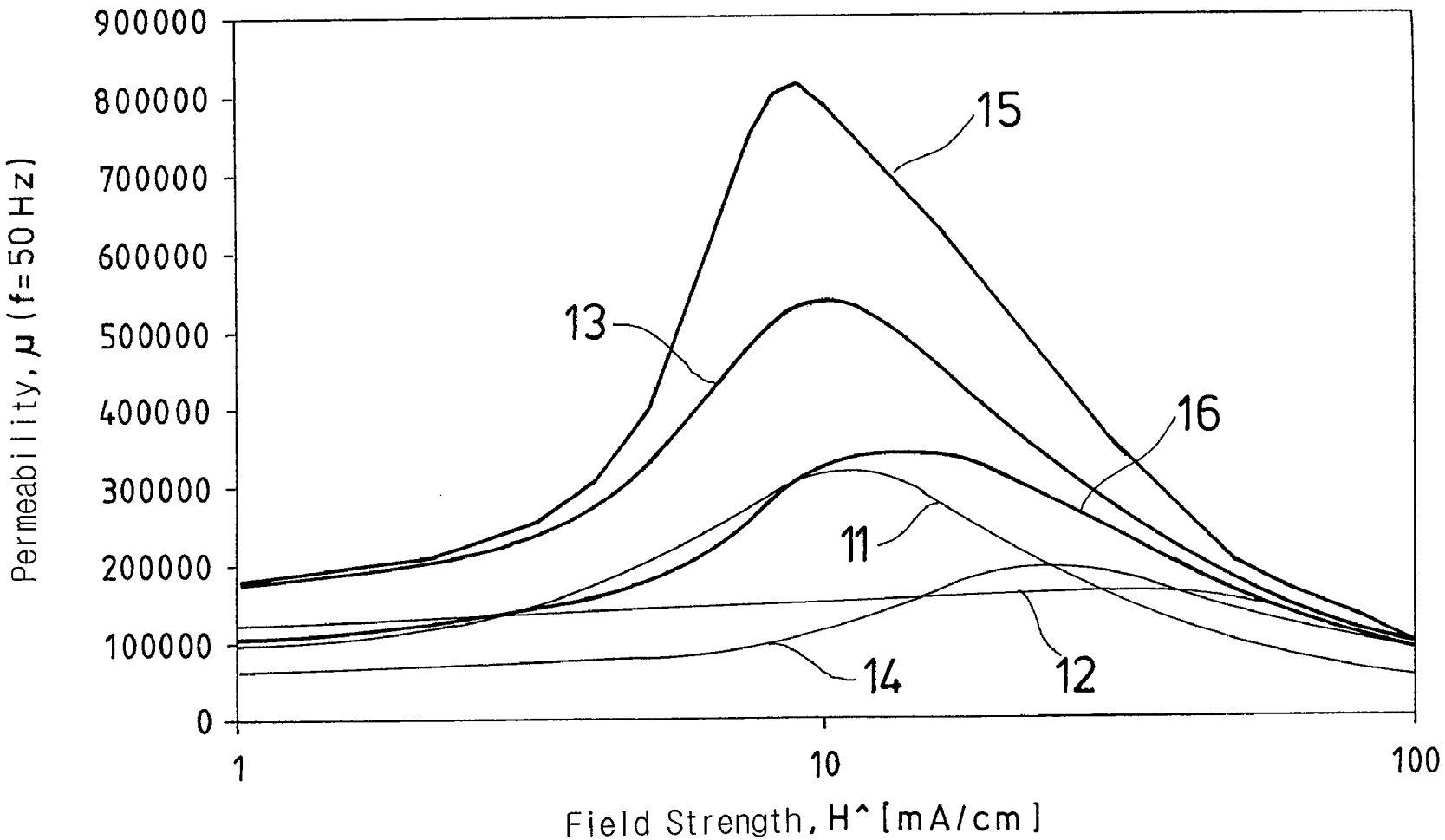
FIG. 7 shows an overview of the permeability properties of transformer cores made of various magnetic materials after different heat treatments.

The thermal capacity of the heat sink is to be adapted to the weight and height of the cores, for example, by varying the plate thickness. With optimum adaptation, excellent magnetic characteristic values ($\mu_{max}$ (50 Hz)>350,000; $\mu_4$>90,000) can thus be achieved over a wide weight range. With the inventive manufacturing method, these cores are far superior to the previous current transformer cores made of NiFe or of nanocrystalline material having a flat loop according to FIG. 7.

FIG. 1 shows schematically a tower furnace for performing the inventive heat treatment. The tower furnace has a furnace housing in which the annealing zone runs vertically. The unstacked amorphous transformer cores are conveyed through an annealing zone running vertically by a conveyor belt running vertically.

The vertically running conveyer belt has heat sinks that are made of a material having a high thermal capacity, preferably copper, standing perpendicular to the surface of the conveyor belt. The transformer cores sit with their end faces on the supports. The vertically running annealing zone is subdivided into multiple separate heating units, each provided with a separate heating regulating unit.

FIG. 1 shows specifically: annealing goods discharge 104, protective gas air locks 105, 110, annealing goods charging 109, heating zone with reducing or passive gas 107, crystallization zone 133, heating zone 134, aging zoneb 106, conveyor belt 108, furnace housing 132, supporting surface 103 as a heat sink for the transformer cores 102, protective gas air lock 101.

Figure 2:
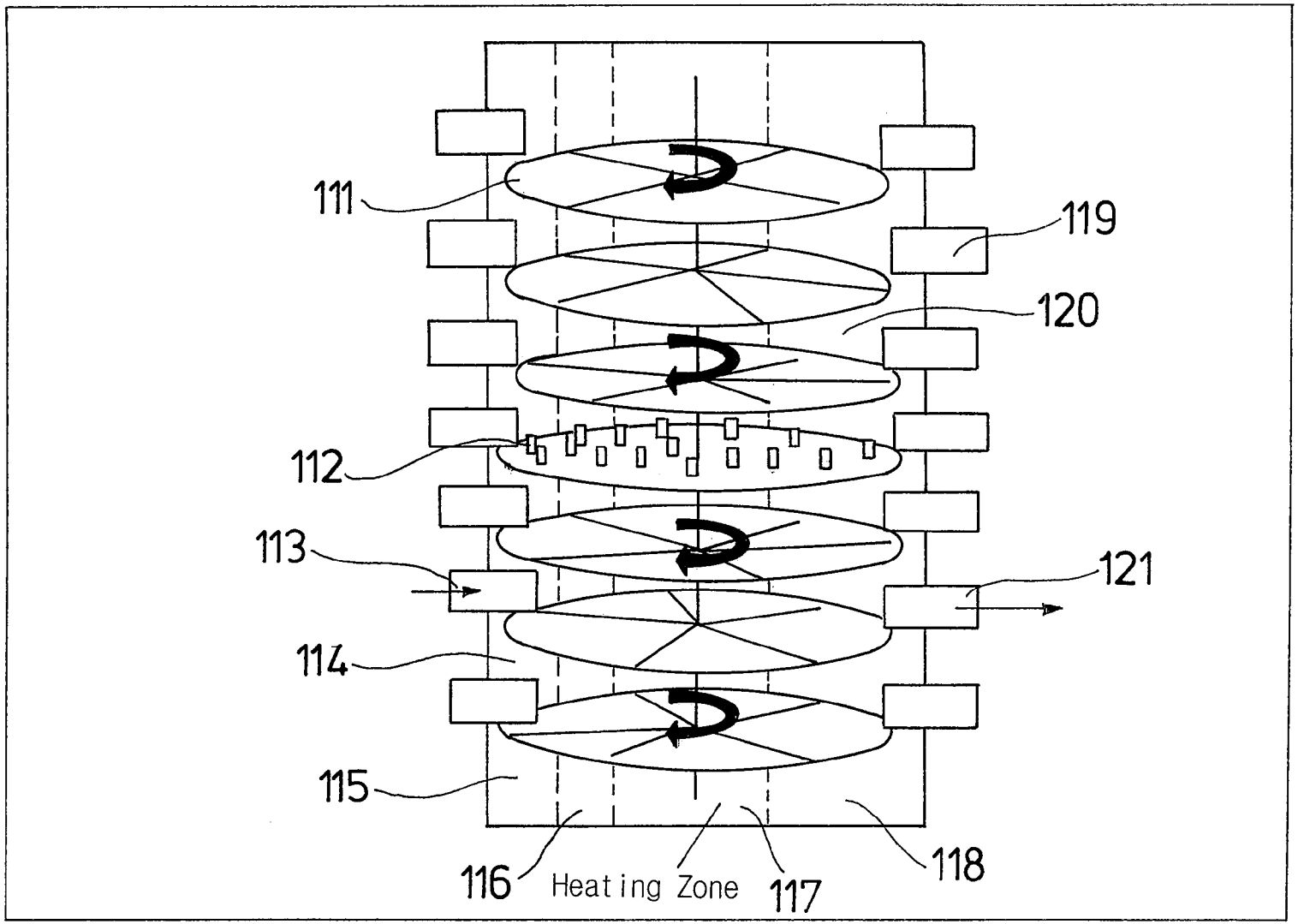
FIG. 2 shows a multistage carousel furnace.

FIG. 2 shows another embodiment of such a furnace. Here again, the design of the furnace is that of a tower furnace in which the annealing zone runs horizontally, however. The horizontally running annealing zone is in turn subdivided into multiple separate heating zones, each equipped with a separate heating regulating unit. One but preferably several supporting plates rotating about the axis of the tower furnace and functioning as heat sinks are in turn provided as means for conveying the unstacked amorphous ring strip-wound cores through the horizontally running annealing zone.

The supporting plates in turn are made entirely or partially of a material having a high thermal capacity and a high thermal conductivity with the end faces of the magnetic cores resting on this material.

FIG. 2 shows the following details: rotary supporting surface as a heat sink 111, transformer cores 112, annealing goods charging 113, annealing zone with reducing or passive protective gas 114, heating zone 115, crystallization zone 116, heating zone 117, aging zone 118, annealing good discharge 121, heating space with reducing or passive protective gas 120, protective gas air lock 119.

Figure 3:
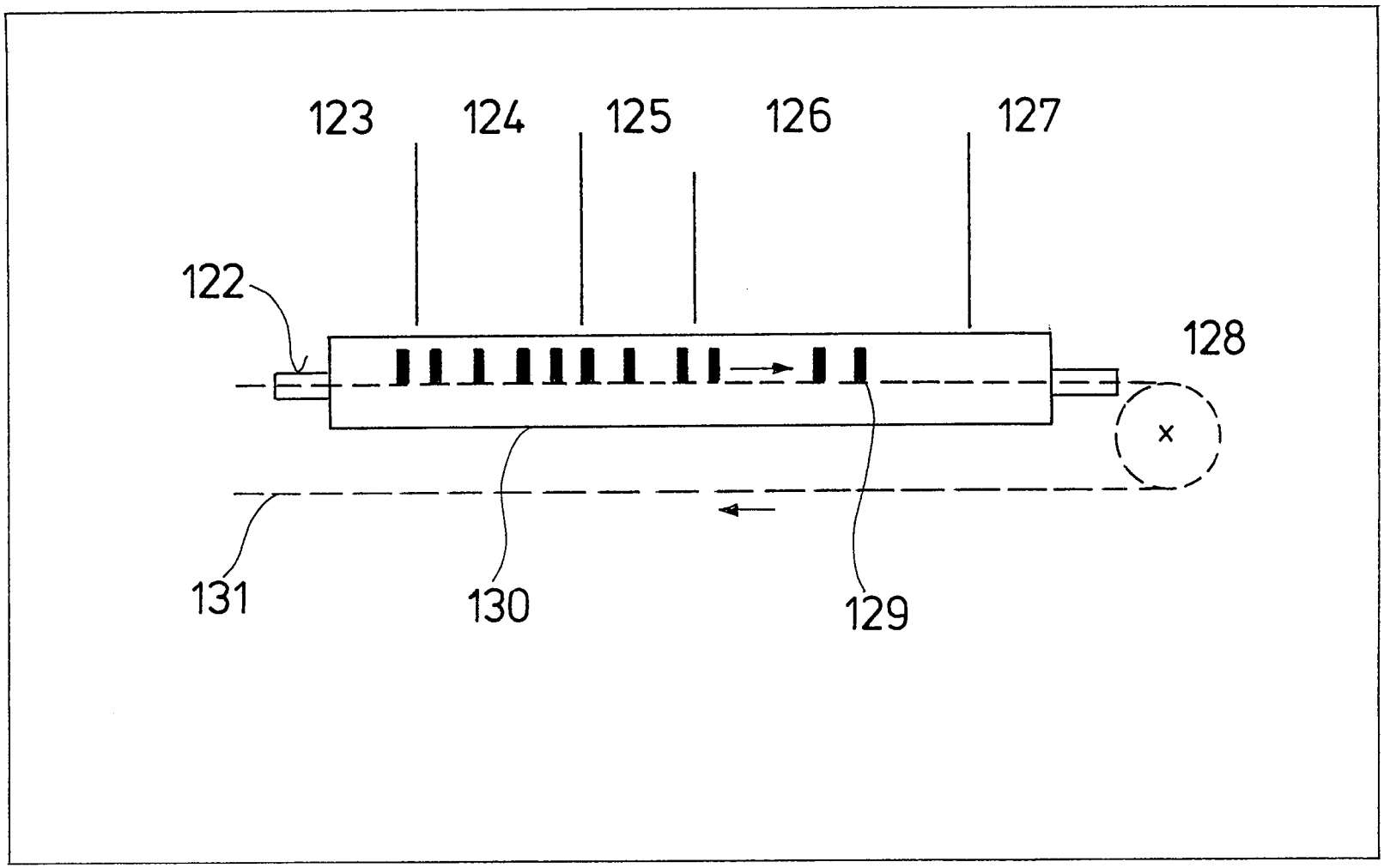
FIG. 3 shows a through furnace having a conveyor belt running horizontally.

Finally, FIG. 3 shows a third embodiment of a furnace in which the furnace housing is in the shape of a horizontal continuous furnace. The annealing zone again runs horizontally. This embodiment is especially preferred because such a furnace, in contrast with the two furnaces mentioned above, can be manufactured at a lower cost and with less complexity.

The transformer cores designed as ring strip-wound cores are conveyed through the horizontally running annealing zone by a conveyor belt, whereby the conveyor belt is preferably in turn provided with supports which function as heat sinks. Again, copper plates are especially preferred here. In an alternative embodiment of this conveyance, plates rolling on rollers through the furnace housing are used as the heat sinks.

As FIG. 3 indicates, the horizontally running annealing zone is in turn subdivided into multiple separate heating zones, each equipped with a separate heating regulating unit. FIG. 3 shows specifically: flushing zone with passive protective gas 122, heating zone 123, crystallization zone 124, heating zone 125, aging zone 126, cooling zone 127, flushing zone with passive protective gas 128, transformer cores 129, annealing zone with protective gas 130, conveyor belt 131.

Figure 4:
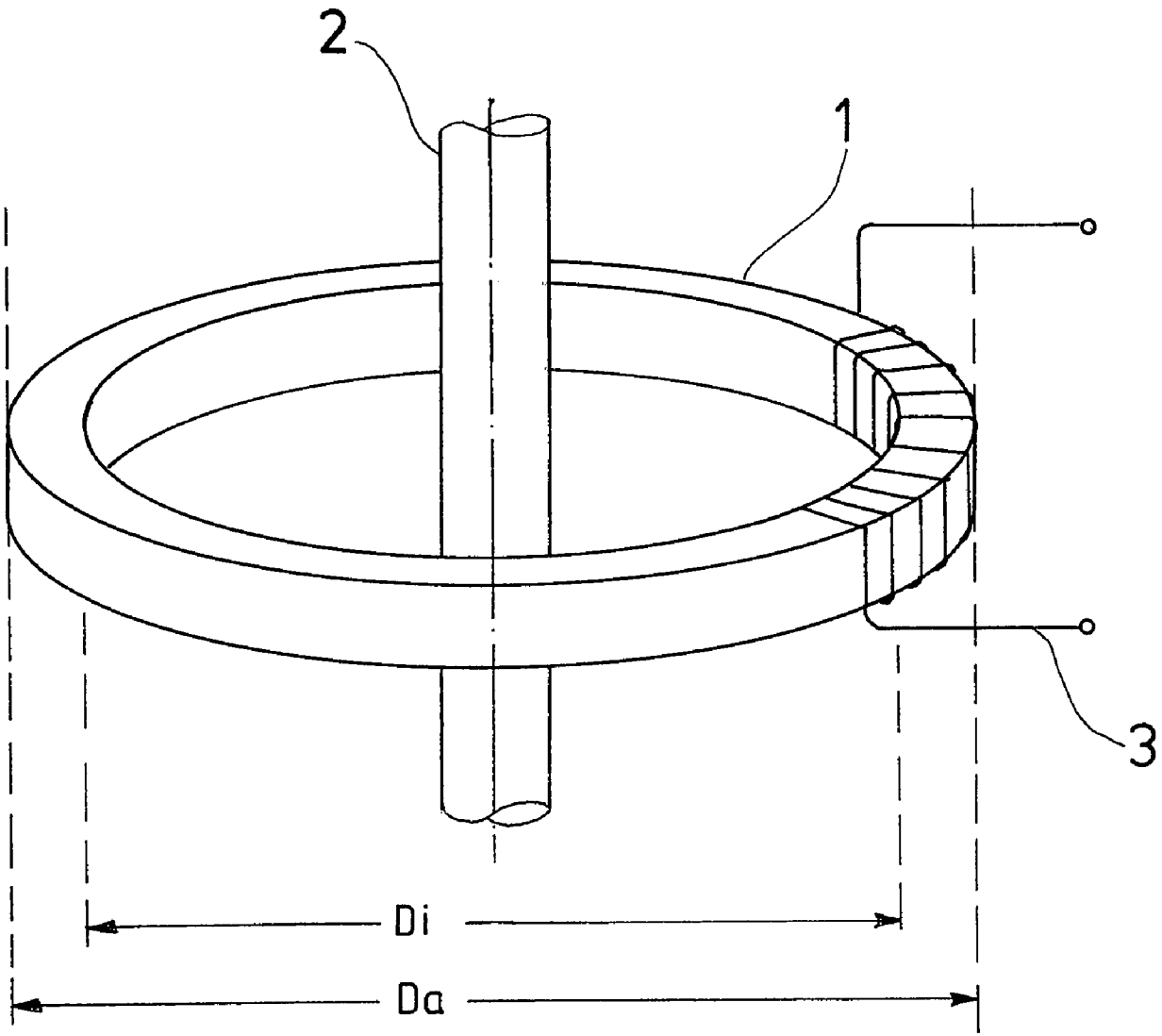
FIG. 4 shows a schematic diagram of a current transformer.

FIG. 4 shows schematically a current transformer having a transformer core 1, a primary current conductor 2 and a secondary conductor 3 wound in the form of a coil onto the transformer core. The transformer core 1 is designed as a circular ring having the ratio of the diameter $D_a$ (outside diameter) to $D_i$ (inside diameter) shown in the figure, where $D_a$ and $D_i$ are based on the magnetic material of the core. As already described above, current transformer cores are characterized by low $D_a/D_i$ ratios, whereby it holds that $D_a/D_i<1.5$ or even $<1.25$. Transformer cores made of nanocrystalline material having such low diameter ratios as in this case can be produced without stresses and deformation only by the inventive heat treatment method.

The primary conductor 2 may be designed as a single conductor passing through the transformer core or alternatively as a winding similar to the winding of the secondary conductor 3.

Figure 5:
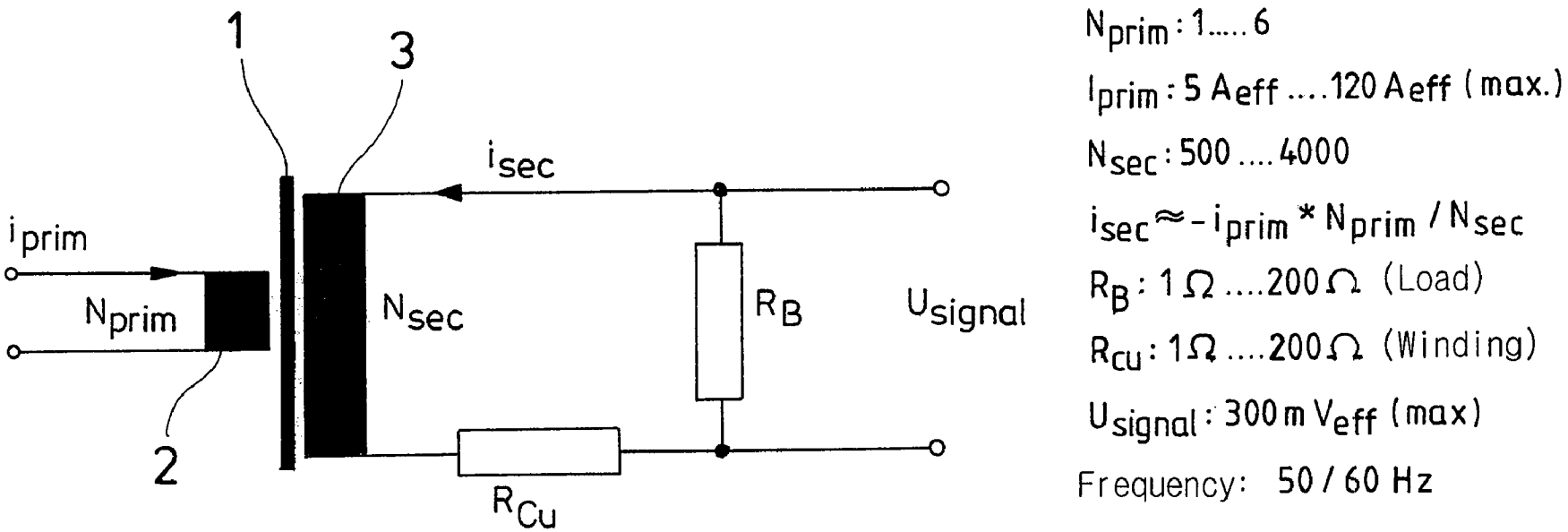
FIG. 5 shows the equivalent diagram of a current transformer.

FIG. 5 shows the equivalent diagram of a current transformer, illustrated three-dimensionally in FIG. 4, where the same reference numerals are used to refer to the same elements.

Figure 6:
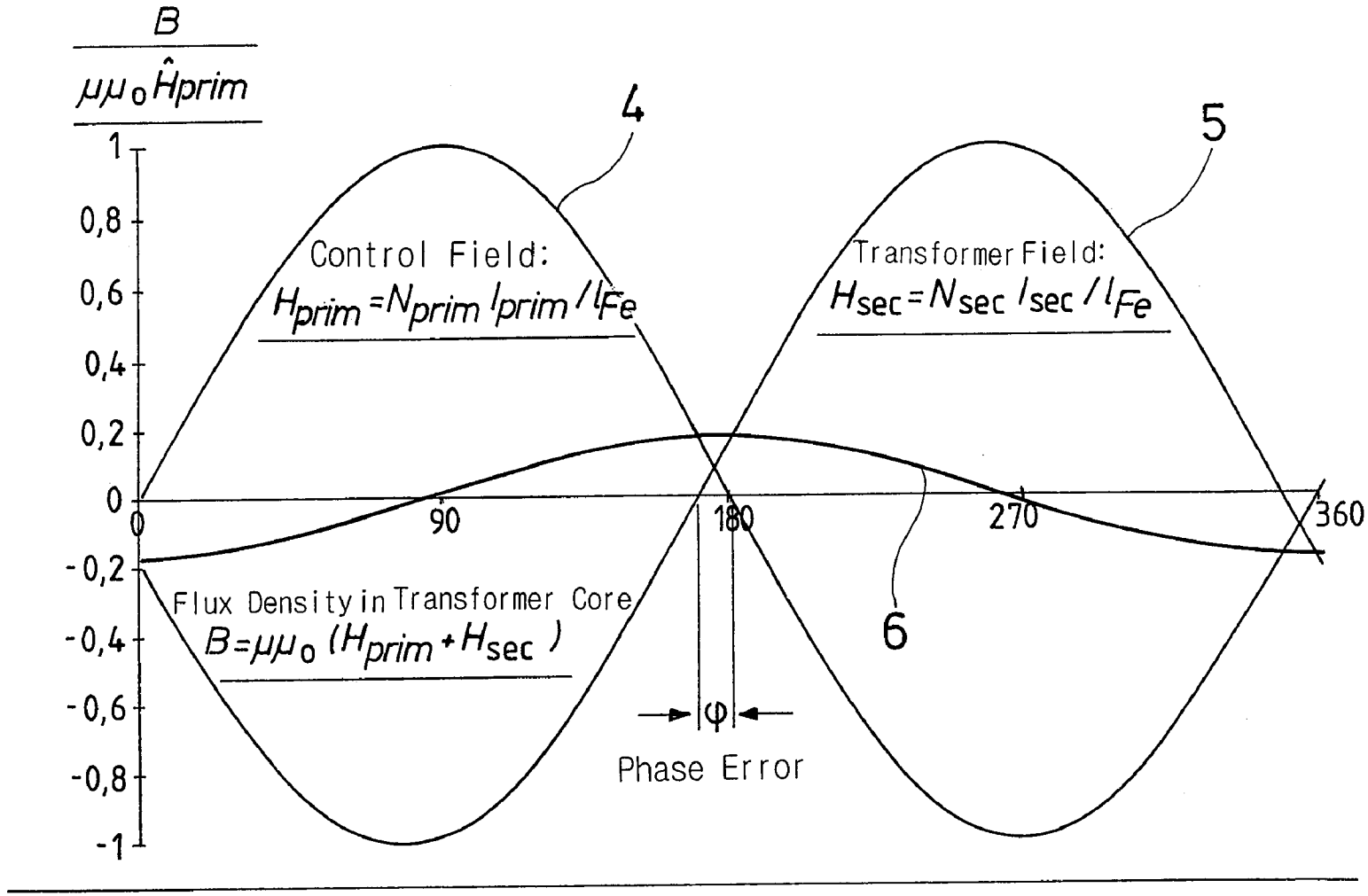
FIG. 6 shows the phase characteristic of an inventive transformer core.

FIG. 6 shows the field strength of the primary field $H^{prim}$ as a first curve 4. A second curve 5 shows the induced opposing field or transformer field $H_{sec}$ and the third curve 6 shows the flux density B in the transformer core.

This figure also shows the phase error $\phi$ and the angle difference between $H_{prim}$ and $-H_{sec}$.

A few selected exemplary embodiments which should illustrate the present invention in comparison with the state of the art are described below.

EXAMPLE 1

According to the state of the art, a transformer core with the dimensions 22×16×5.5 mm having a filling factor of 87% and a weight of 7.45 g was manufactured from Permalloy. The permeability shown in FIG. 7 (curve 1) was $\mu_4$=170,000. According to FIG. 9*a* (curve 11) the same precision as with the inventive Example 3 was achieved only in a greatly limited current range with a primary winding number of 1, a secondary winding number of 2500 and a load resistance of 12.5 Ω at a nominal current 60 A. The maximum current range that could be mapped here was only 75 A on the basis of the lower saturation induction of 0.74 T; for currents below 1 A the phase error $\phi$ increased in an unacceptable manner in comparison with Example 3.

EXAMPLE 2

A core with the dimensions 47×38×5 mm (filling factor 80%) was wound using the alloy $Fe_{75.5}Cu_1Nb_3Si_{12.5}B_8$. The heat treatment was performed by stack annealing in a retort furnace where the aging of the structure and equalization of magnetostriction were performed for 1 hour at 567° C. This was followed by a 3-hour heat treatment at 422° C. under a transverse field. However, to prevent exothermic overheating between 430° C. and 500° C., heating was performed at an extremely slow rate of 0.1° C./min. Therefore, the entire heat treatment performed under $H_2$ lasted approximately 19 hours and was extremely uneconomical. Owing to the force acting during the annealing, the core developed the shape illustrated in FIG. 8*c*. Because of the transverse field corresponding to the state of the art as well as the mechanical damage due to the field forces, the permeability was relatively low, i.e., according to FIG. 7 (curve 12) it was $\mu_4$=140,000. According to FIG. 9*a* (curve 22), this core was far inferior to the crystalline state of the art and was discarded because the phase angle of the transformer was too large over a wide current range.

EXAMPLE 3

Rapidly solidified strip having the composition $Fe_{73.5}Cu_1Nb_3Si_{15.5}B_7$ was cut to a width of 6 mm, protectively insulated with MgO and coiled without stress to form a ring strip-wound core having a low $D_a/D_i$ ratio and the dimensions 23.3×20.8×6.2 [mm] (filling factor 80%). This core weighing 3.16 g was then tempered in a horizontal continuous furnace according to FIG. 3, where the total tempering time amounted to 43 minutes. A 4 mm thick copper plate was used as the substrate. The temperature increased gradually from 440° C. in the crystallization zone to 568° C. in the aging zone, where it was kept constant for 20 minutes. The permeability of the material represented in FIG. 7 (curve 13) was $\mu_4$=276,000.

Figure 9A:
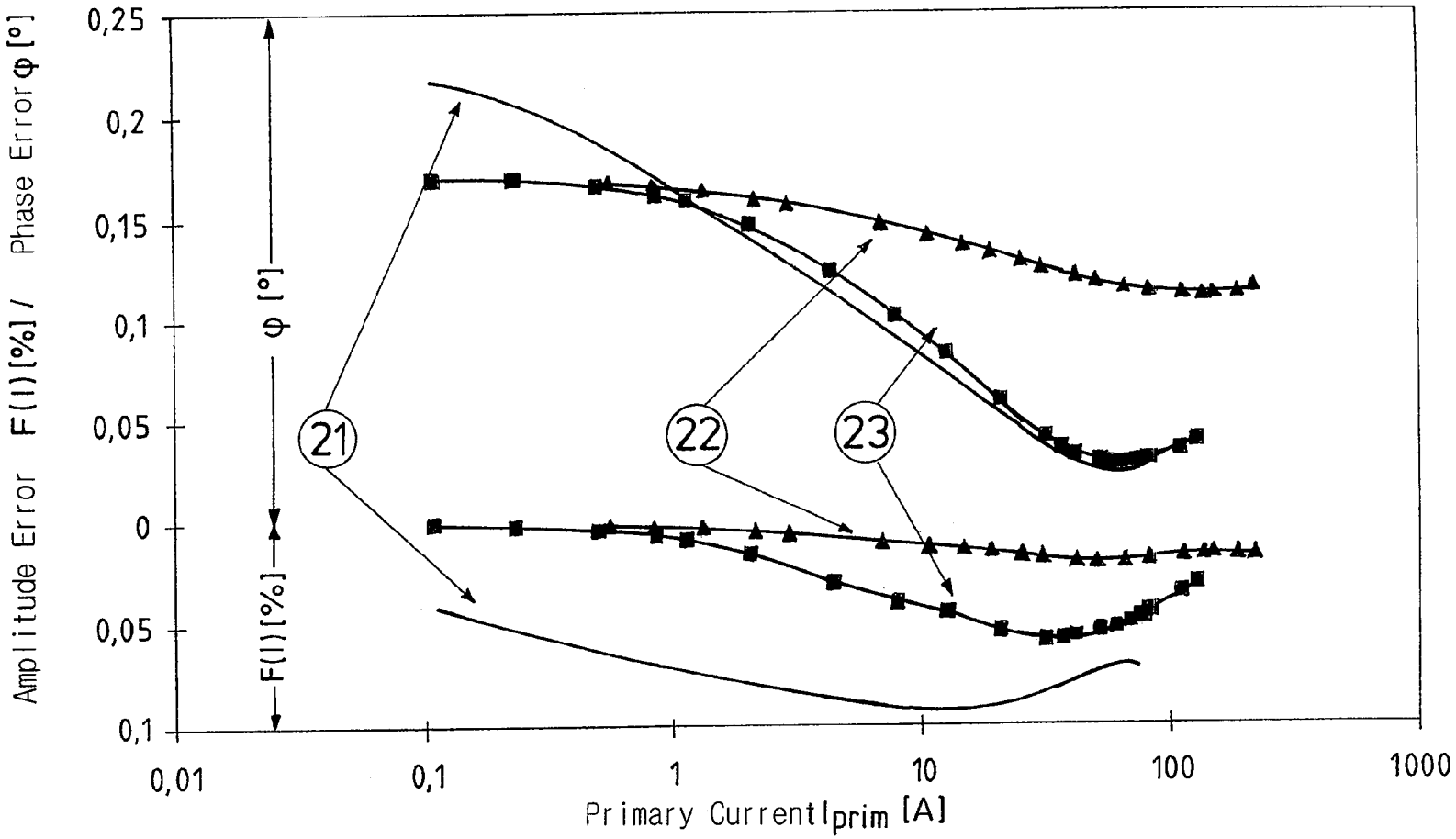
FIGS. 9*a* and 9*b* shows amplitude errors and phase errors of current transformers made up of transformer cores made of various materials.

The core was secured in stress-free manner with a synthetic resin coating and wound with a secondary winding of $N_{sec}$=2500 according to FIG. 4 and wired with a load resistance of 12.5 Ω according to FIG. 5. The resulting current transformer was very suitable for a rated current of 60 A, with the maximum mappable current range being 129 A due to the high saturation induction of $B_s$=1.22 T. As indicated in FIG. 9*a* (curve 23), the maximum phase error $\phi$ was 0.17°.

EXAMPLE 4

Figure 8B:
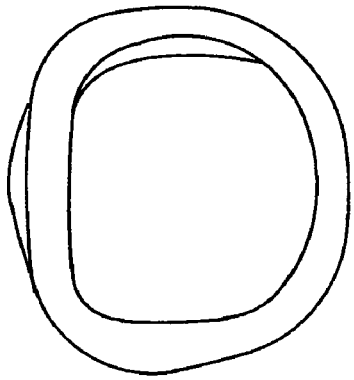
Figure 9B:
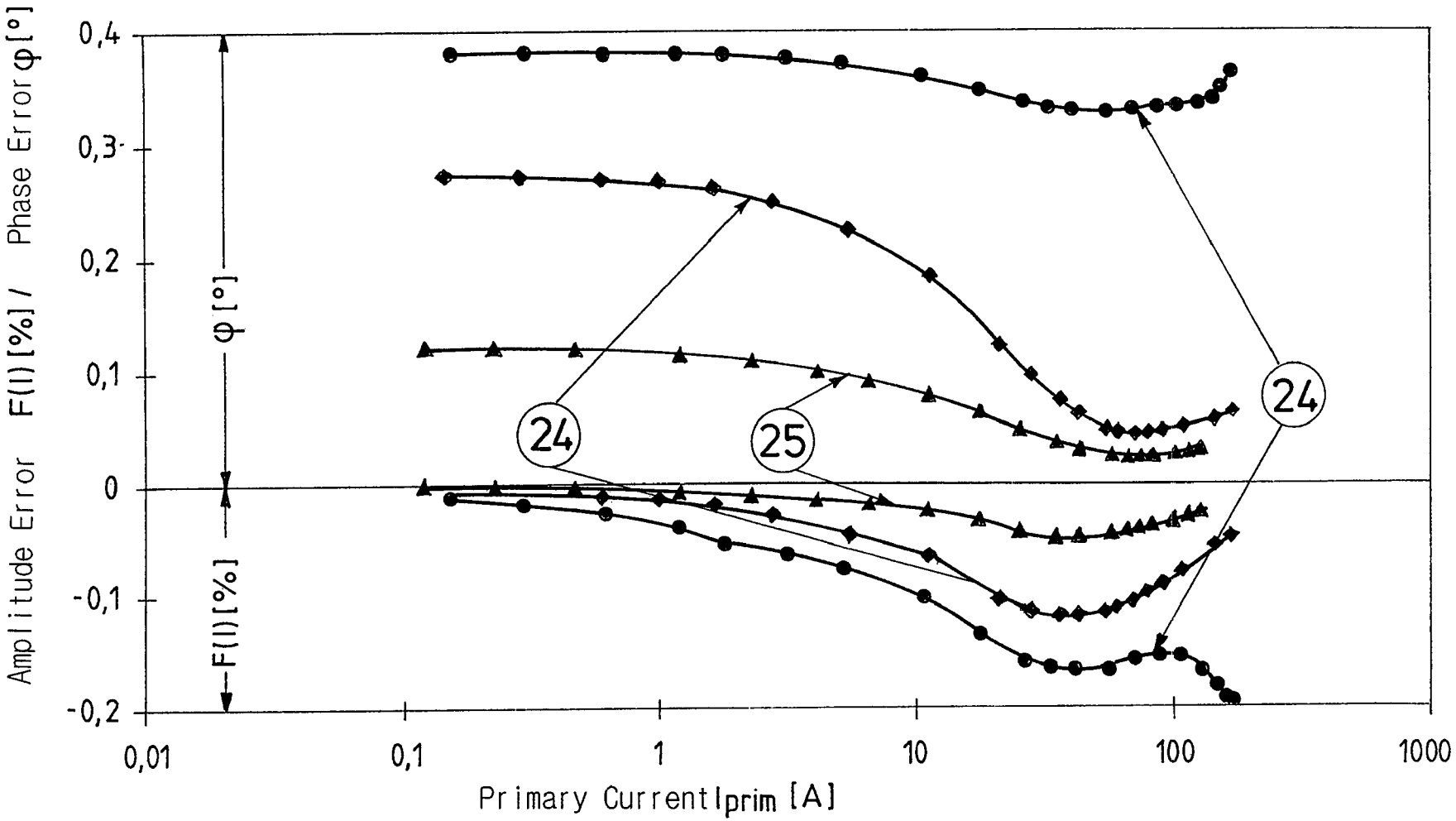

A core having the dimensions 47×38×5 mm was wound using the same alloy. However, the heat treatment was performed by stack annealing in a retort furnace where the heat treatment was performed for structural aging and for equalization magnetostriction for 1 hour at 567° C. However, to prevent exothermic overheating, the heating rate was extremely slow at 0.1° C./min between 440° C. and 500° C. Therefore, the total heat treatment lasted approximately 16 hours and was extremely uneconomical. Because of mechanical pressures in the core stack in the retort furnace, the core was mechanically highly unstable because of its geometry, developed the deformation illustrated in FIG. 8*b*. Because of this damage and the magnetostatic stacking effect, the permeability was very low, amounting to $\mu_4$=77,000 according to FIG. 7 (curve 14). This core was therefore worse than the crystalline-state of the art and was discarded because the phase error $\phi$ according to FIG. 9*b* (curve 24) was too large.

EXAMPLE 5

Rapidly solidified strip having the composition $Fe_{73.5}Cu_1Nb_3Si_{14}B_{8.5}$ was cut to a width of 6 mm, provided with protective insulation with MgO and wound in a stress-free manner to form a ring core having a low $D_a/D_i$ ratio and the dimensions 23.3×20.8×6.2 [mm] (filling factor 80%). This core weighing 3.16 g was then tempered in a horizontal continuous furnace according to FIG. 3, where the total tempering time amounted to 55 minutes. An 8 mm thick copper plate was used as the substrate. The temperature in the crystallization zone was 462° C. and the temperature in the aging zone was 556° C. The permeability of the material represented in FIG. 7 with curve 15 was $\mu_4$=303,000.

The core was encapsulated in the plastic trough, wound with a secondary winding of $N_{sec}$=2500 according to FIG. 4 and wired with a load resistance of 12.5 Ω according to FIG. 5. The resulting current transformer was highly suitable for a rated current of 60 A, with the maximum mappable current range being 132 A on the basis of the high saturation induction of $B_s$=1.22 T. As indicated on the basis of FIG. 9*b* (curve 25), the phase error $\phi$ is max. 0.12°.

EXAMPLE 6

Figure 8A:
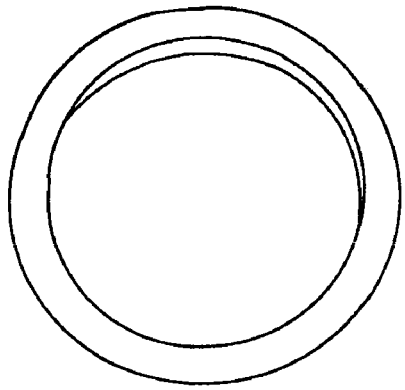
FIGS. 8*a*, 8*b*, 8*c* show the condition of ring strip-wound cores typical of current transformers having a small $D_a/D_i$ ratio after a continuous annealing (8*a*) and after stack annealing without [magnetic field] (8*b*) and with magnetic field (8*c*)
Figure 8C:
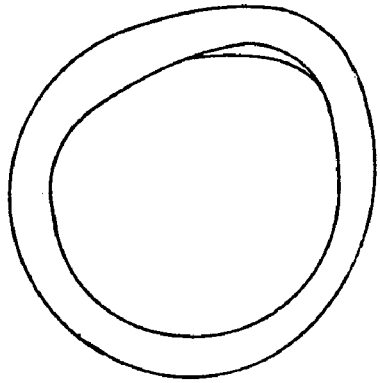

Rapidly solidified strip having the composition $Fe_{73.5}Cu_1Nb_3Si_{14}B_{8.5}$ was cut to a width of 6 mm, provided with protective insulation with MgO and wound in a stress-free manner to form a ring core having a low $D_a/D_i$ ratio and the same dimensions 47×38×5 [mm] (filling factor 80%) as in examples 2 and 4. It was then tempered in a horizontal continuous furnace according to FIG. 3, where the total tempering time was 180 minutes. A 2-mm-thick copper plate was used as the substrate. The temperature in the crystallization zone was 455° C. and in the aging zone, which was passed through in 150 minutes, was 545° C. The permeability of the material represented as curve 16 in FIG. 7 was $\mu_4$=160,000. As FIG. 8*a* shows, this core retains its round shape after continuous annealing.

The core was achieved with a thin plastic layer by the CVD method and wound with a secondary winding of $N_{sec}$=2500 according to FIG. 4 and wired with a load resistance of 12.5 Ω according to FIG. 5. The resulting current transformer was highly suitable for a current rating of 60 A, whereby owing to the high saturation induction of $B_s$=1.3 T the maximum mappable current range was 172 A. As indicated on the basis of FIG. 9*b* (curve 26), the phase error $\phi$ is max. 0.27°.

EXAMPLE 7

Rapidly solidified strip having the composition $Fe_{73.5}Cu_1Nb_3Si_{14}B_{8.5}$ was cut to a width of 6 mm, provided with protective insulation with MgO and wound in a stress-free manner to form a ring strip-wound core with a low $D_a/D_i$ ratio and the same dimensions 47×38×5 [mm] (filling factor 80%). It was then tempered in a horizontal continuous furnace according to FIG. 3 using a 6-mm-thick copper plate as the substrate. The entire heating zone was passed through in 5 minutes. The temperature was set at 590° C. The core retained its round geometry according to FIG. 8*a*. The permeability behavior was comparable to that from Example 6.

The core was embedded by impregnating with epoxy resin and processed further to form the current transformer as shown in Example 6. Accordingly, the current transformer data were comparable to those from Example 6.

What is claimed is:

1. A current transformer core comprising a ratio of the core outside diameter $D_a$ to the core inside diameter $D_i$ of <1.5, a saturation magnetostriction $\lambda_s \leqq |4|$ ppm, a round hysteresis loop with $0.50 \leqq Br/Bs \leqq 0.85$ and an $H_{cmax} \leqq 20$ Ma/cm, whereby the current transformer cores consist of a soft magnetic iron-based alloy in which at least 50% of the alloy structure consists of fine crystalline particles with an average particle size of 100 nm or less and the iron-based alloy has essentially the composition:

$$(Fe_{x-a}Co_aNi_b)_xCu_yM_zSi_vB_w$$

where M denotes an element from the group V, Nb, W, Ta, Zr, Hf, Ti, Mo or a combination thereof and in addition:

x+y+z+v+w=100%, where

Fe+Co+Ni=x=100%−y−z−v−w

Co $a \leqq 1.5$ at %

Ni $b \leqq 1.5$ at %

Cu $0.5 \leqq y \leqq 2$ at %

M $z \leqq 5$ at %

Si $6.5 \leqq v \leqq 18$ at %

B $5 \leqq w \leqq 14$ at % wherein v+w>18 at%.

2. The current transformer core according to claim 1, comprising a saturation magnetostriction $\lambda_s \leqq |2|$ ppm, a round hysteresis loop with $0.50 \leqq Br/Bs \leqq 0.70$ and an $H_{cmax} \leqq 10$ Ma/cm, whereby the current transformer core is made of a soft magnetic iron-based alloy in which at least 50% of the alloy structure consists of fine crystalline particles with an average particle size of 100 nm or less and the iron-based alloy has essentially the composition:

$$(Fe_{x-a}Co_aNi_b)_xCu_yM_zSi_vB_w$$

where M denotes an element from the group V, Nb, W, Ta, Zr, Hf, Ti, Mo or a combination thereof and in addition:

x+y+z+v+w=100%, where

Fe+Co+Ni=x=100%−y−z−v−w

Co $a \leqq 0.5$ at %

Ni $b \leqq 0.5$ at %

Cu $0.75 \leqq y \leqq 1.25$ at %

M $2.0 \leqq z \leqq 3.5$ at %

Si $13 \leqq v \leqq 16.5$ at %

B $5 \leqq w \leqq 9$ at % whereby $20 \leqq v+w \leqq 25$ at %.

3. Current transformer core according to claim 2, comprising a saturation magnetostriction $\lambda_s \leqq |0.8|$ ppm, a round hysteresis loop with $0.65 \leqq Br/Bs \leqq 0.50$ and an $H_{cmax} \leqq 10$ Ma/cm, whereby the current transformer core is made of a soft magnetic iron-based alloy in which at least 50% of the alloy structure consists of fine crystalline particles with an average particle size of 100 nm or less and the iron-based alloy has the following stoichiometric ratio:

$$(Fe_{x-a}Co_aNi_b)xCuyMzSivBw$$

where M denotes an element from the group V, Nb, W, Ta, Zr, Hf, Ti, Mo or a combination thereof and in addition:

$x+y+z+v+w=100\%$, where $Fe+Co+Ni=x100\%-y-z-v-w$

Co $a \leqq 0.5$ at %

Ni $b \leqq 0.5$ at %

Cu $0.75 \leqq y \leqq 1.25$ at %

M $2.0 \leqq z \leqq 3.5$ at %

Si $13 \leqq v \leqq 16.5$ at %

B $5 \leqq w \leqq 9$ at % whereby $20 \leqq v+w \leqq 25$ at %.

4. The current transformer core according to claim 1, comprising a $\mu_4 > 90{,}000$.

5. The current transformer core according to claim 1, comprising a $\mu_{max} > 350{,}000$.

6. The current transformer core according to claim 1, comprising a saturation induction $B_s \leqq 1.4$ Tesla.

7. The current transformer core according to claim 1, for a current transformer having a phase error $<1°$.

8. The current transformer core according to claim 1, wherein the current transformer core is designed as a ring strip-wound core having at least one primary winding and at least one secondary winding.

* * * * *